United States Patent [19]

Jimenez

[11] 4,413,358

[45] Nov. 8, 1983

[54] MOTORCYCLE SAFETY BELT

[76] Inventor: Albert Jimenez, 16225 Sierra Ridge Way, Hacienda Heights, Calif. 91745

[21] Appl. No.: 246,744

[22] Filed: Mar. 23, 1981

[51] Int. Cl.[3] ..... A41F 9/00

[52] U.S. Cl. ..... 2/321; 2/311

[58] Field of Search ..... 2/321, 311, 312, 93, 2/300, 301, 325; 182/3

[56] References Cited

U.S. PATENT DOCUMENTS

| | | | |
|---|---|---|---|
| 3,533,107 | 10/1970 | Raneri | 2/311 |
| 3,840,902 | 10/1974 | McNeill | 2/311 |
| 3,896,499 | 7/1975 | Kelly | 3/311 |
| 4,028,742 | 6/1977 | Marquis | 2/311 |

*Primary Examiner*—Doris L. Troutman

*Attorney, Agent, or Firm*—Edgar W. Averill, Jr.

[57] ABSTRACT

A motorcycle safety belt having handles for use by a rider positioned behind the driver. The belt has a buckle and handles which are positioned on each side of the driver and held by the rider.

4 Claims, 3 Drawing Figures

FIG. 1.
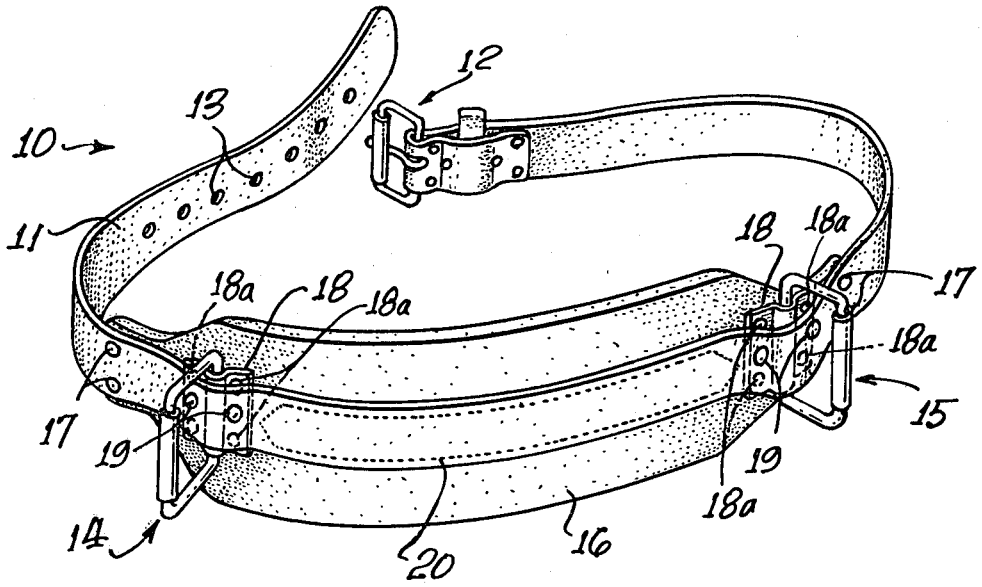
FIG. 2.
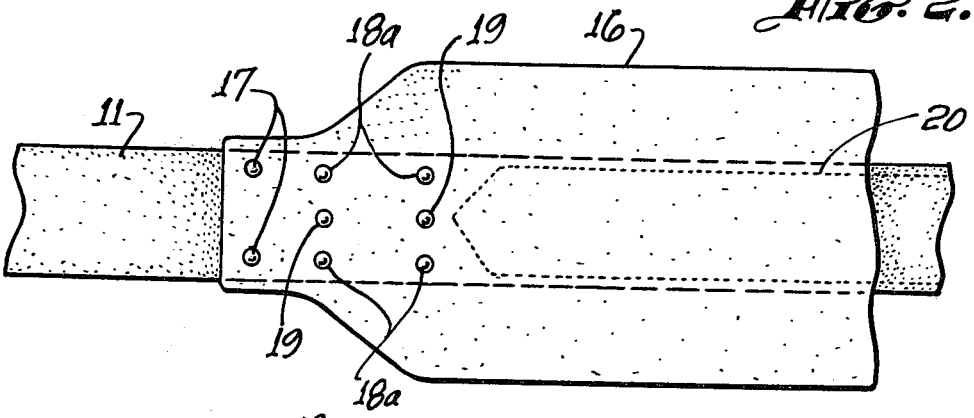
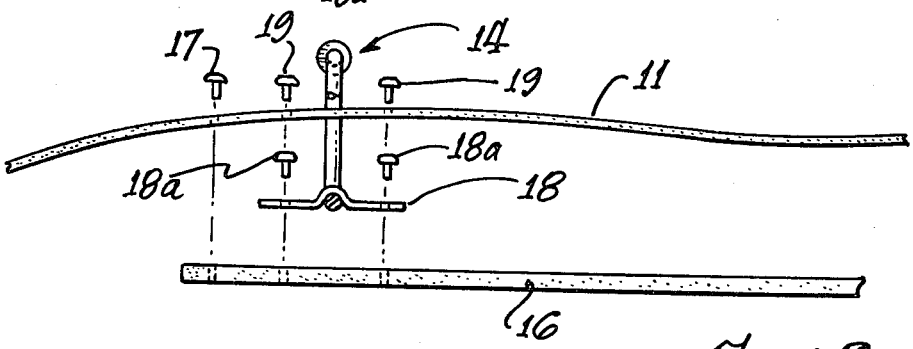
FIG. 3.

MOTORCYCLE SAFETY BELT

BACKGROUND OF THE DISCLOSURE

For many years, it has been common for motorcycle drivers to carry a rider. Most motorcycles, however, are not equipped to hold a rider in a safe manner, and it is a common sight to see a rider holding on to the shirt of the driver or grasping him around the waist. This, of course, potentially interferes with the driver's ability to control the motorcycle in the event of an emergency, and a safer method for securing the driver is needed. Various brackets often referred to as "sissy bars" are used to help hold a rider but often these constitute a safety hazard in the event of a spill.

SUMMARY OF THE INVENTION

The present invention is for a safety belt for use by the driver of a motorcycle which has a rider in addition to the driver to enable the rider on the motorcycle to more easily hold on to the driver. The belt has a belt member adapted to gird the driver"s waist. A buckle is affixed to the belt member to hold the belt in a secure position around the driver. The belt has at least two handle means affixed in a manner to prevent movement of the handle means along the belt. The first of the handle means is affixed so that it is positioned on the side and near the rear of the driver on the right side, and the second is similarly positioned on the left side. Preferably, the handle means are generally rectangular. In a preferred embodiment, the belt is of a wider width in the back than in the front, and the handle means are affixed in the widened portion.

BRIEF DESCRIPTION OF THE DRAWINGS

FIG. 1 is a perspective view of the belt of the present invention.

FIG. 2 is an enlarged fragmentary side elevation of the inner surface of a portion of the belt of FIG. 1.

FIG. 3 is a top exploded, fragmentary view of the handle portion of the belt of FIG. 1.

DESCRIPTION OF THE PREFERRED EMBODIMENTS

The belt of the present invention is shown in perspective view in FIG. 1 and indicated generally by reference character 10. The belt has a belt member or strap portion 11 which is adapted to gird the driver's waist in a conventional manner. A buckle 12 and holes 13 are likewise conventional.

A pair of handles 14 and 15 are securely affixed to that portion of the belt which would be near each side of the driver to provide a place for a motorcycle rider to grasp. Handles 14 and 15 are generally rectangular and are preferably secured around the belt member 11 to prevent a dislodging in the unlikely event the rivets which hold it to the belt work loose.

The belt 10 also has a widened portion 16 which serves to distribute any pressure caused by the grip of the rider and greatly facilitates comfort on long rides.

As shown best in FIG. 2, the widened portion 16 of belt 10 is riveted to the strap portion 11 by rivets 17. As shown in FIG. 3, handle 14 is pivotally held in support plate 18 which in turn is riveted to the widened portion 16 by rivets 18*a*. Rivets 19 pass through belt 11, plate 18 and widened portion 16 to assist in forming a secure assembly. The above-mentioned rivets are held in the belt by conventional mating rivet members on the back side of the belt, not shown. Additionally, a strap and snap assembly may be added to the outer surface of the belt to hold the handle in a retracted position.

It has been found that the provision of a widened portion makes the belt of the present invention far more comfortable, and a preferable width is about six inches in combination with a belt width of about two inches. The belt may be made from conventional materials such as leather.

While the rectangular shape is preferred, other variants of this shape may, of course, be used keeping in mind the need for comfort. By the use of the belt of the present invention, it is possible to ride for long distances in safety and comfort.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A safety belt for use by the driver of a motorcycle which has a rider in addition to the driver to enable the rider on the motorcycle to more easily hold on to the driver, said belt comprising:

a belt member adapted to gird the driver's waist;

buckle means affixed to the belt member to hold the belt member in a secure position around the driver; and at least two generally rectangular, rigid handle means affixed to the belt member in a manner to prevent movement of the handle means along the belt member, the first of said handle means being affixed so that it is positioned on the side and near the rear of the driver on the right side and the second of said handle means being affixed so that it is positioned on the side and near the rear of the driver on the left side, each of said handle means being affixed to the belt member along one side of the generally rectangular, rigid handle means so that it is pivotable about the side which is affixed to the belt, whereby the rider may grasp the handles and easily and securely hold himself on the motorcycle.

2. The belt of claim 1 wherein the portion of the belt member which is adjacent each of the handle means is greater in width than that portion of the belt which is in the front of the driver.

3. The belt of claim 2 wherein the belt portion which is in front of the driver is about two inches wide and the portion of the belt which is adjacent the handle means is about six inches wide.

4. The belt of claim 1 wherein each of the handle means is about four inches high and two inches wide.

* * * * *